METHOD OF FORMING AN ELECTROFORMING MANDREL

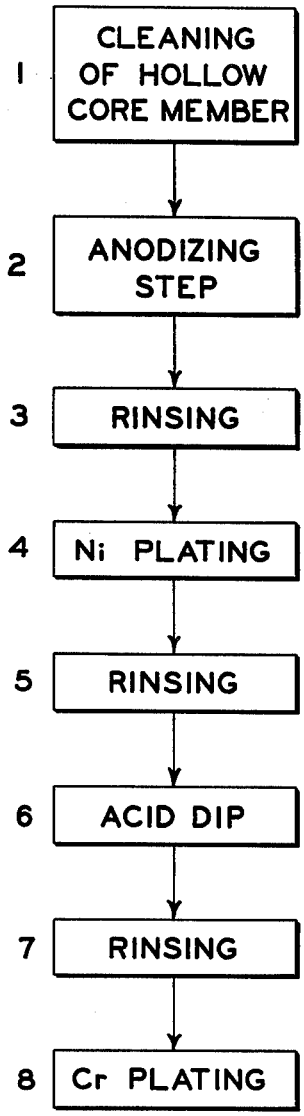
1
CLEANING OF HOLLOW CORE MEMBER
2
ANODIZING STEP
3
RINSING
4
Ni PLATING
5
RINSING
6
ACID DIP
7
RINSING
8
Cr PLATING

BACKGROUND OF THE INVENTION

This invention relates in general to a process for making nickel coated mandrels suitable for chromium coating for use in an electroforming process for the production of endless seamless nickel xerographic belts.

U.S. Pat. No. 3,905,400 discloses a cylindrically shaped hollow mandrel which is suitable in an electroforming process used for the production of endless seamless nickel xerographic belts. The mandrel comprises a core member which has a thin removable metal sleeve having a thickness between about 10 and 60 mils which is fitted over the core member to provide a surface for electroforming of nickel belts. The sleeve concept had certain shortcomings in that it was difficult to obtain a uniform surface between the nickel sleeve and the aluminum core. The solution in which the sleeve and core were being subjected tended to creep into the space between the sleeve and the aluminum core and form a galvanic cell where corrosion began. Since it is very difficult to obtain a perfect fit between the mandrel core and the sleeve, the surface area between the sleeve and the mandrel core would begin to corrode very quickly.

Prior to the instant invention, another method was used extensively for making mandrels suitable for use in electroforming processes for the production of endless seamless nickel xerographic belts. This was a process where aluminum mandrels were coated with a heavy, excess coating of chromium. Then these mandrels were ground down, i.e. machined, to within the size tolerances required for the mandrels, i.e. diameter, and to the roundness required in order to make the xerographic belt substrates. The plating of the chrome surfaces with excess chrome took about 15 to 20 hours. Then it would take about 15 hours grinding to reduce the thickness of the chrome outer surface of the mandrels to the proper dimensions. This was an expensive and time consuming process.

The instant process has advanced the art of making mandrels so that if the original core member, i.e. mandrel, is within the proper dimensions, then the core member is anodized and then a very thin layer of nickel is coated onto the core. The anodizing treatment of the aluminum core member, i.e. mandrel, forms a protective oxide film on the aluminum so that the aluminum core member can be placed into a subsequent nickel plating bath and the film will be inert to the bath long enough to get a protective layer of nickel plated onto the aluminum. After the nickel plating then a thin layer of chromium is deposited upon the nickel plated core member. This invention eliminates the necessity for the grinding step. The addition of the nickel and chromium layers prevent corrosion of the core member. Also, these layers enhance the good parting of metals when the endless seamless nickel xerographic belts are formed on the hollow core mandrels.

The reason for preferring chrome as an outer surface for the mandrel is that the belts to be made on the mandrels are, as mentioned, nickel. The nickel belts are plated onto the surface of the chrome plated mandrels. The chrome has a naturally occurring oxide and this makes the chrome surface resistive to the formation of a strongly adhering bond with the electro-deposited nickel. Therefore, when the nickel belt is electroplated onto the chromium surface, it is just a matter of having the right stress conditions and the belt slips right off of the mandrels. However, a nickel surface could be used for the mandrels. However, the nickel would have to be passivated periodically, i.e. the nickel surface would have to be nickel oxide, since nickel can be plated onto nickel oxide and these layers will separate without bonding. However, the nickel oxide would be reduced during each cycle. Therefore, a chromium plate surface for the mandrel is preferred since the electrolyte of the nickel bath for the formation of the nickel belts does not reduce the chromium oxide layer. Therefore, the process can continue for many cycles since the chromium oxide is not disturbed.

OBJECT OF THE INVENTION

It is an object of this invention to provide a novel process for making a nickel coated cylindrically shaped hollow core mandrel suitable for chromium coating for use in an electro-forming process for the production of endless seamless nickel xerographic belts.

It is a further object of this invention to provide a novel method of making cylindrically shaped hollow core mandrels which overcome the above-noted disadvantages.

It is a further object of this invention to provide a process for making nickel coated cylindrically shaped hollow core mandrels suitable for chromium coating for use in an electroforming process for the production of endless seamless nickel xerographic belts by (1) providing a cylindrically shaped hollow core member of aluminum or aluminum alloys, (2) placing this core member into an anodizing bath where the cathode comprises lead or lead alloys and the anode is the core member and anodizing the core member and (3) then placing the core member which is now being used as a cathode into a nickel electroforming bath with an anode of nickel or nickel alloys in order to nickel plate the core. Then, optionally and in addition, (4) placing this core member after the nickel plating into an acid dip bath and then (5) placing the core member into a chromium electroforming bath with an anode of lead or lead alloys in order to form a chromium plate on the nickel plated core member cathode.

SUMMARY OF THE INVENTION

The foregoing objects and others are accomplished in accordance with this invention by providing a cylindrically shaped hollow core member, i.e. mandrel, consisting essentially of a material selected from the group consisting of aluminum or aluminum alloys, and subjecting this core member to a novel process for nickel plating so that the core can then be optionally chromium coated for use in an electroforming process for the production of endless seamless nickel xerographic belts. These endless seamless nickel belts are suitable for use as substrates for photoreceptors in an electrophotographic apparatus. These photoreceptors must exhibit relatively high tensile strength to withstand the stresses imposed upon them during use. Also, these photoreceptors must avoid yielding under stress conditions causing slack in the system which gives rise to vibrations and improper tracking of the belts. The belts formed upon the mandrels must be sufficiently ductile to be easily flexed over rollers used to effect rotation of the belt in the electrophotographic machines without destroying the substrates due to these stresses encountered in flexing and rotating in the machines. Moreover, there must Then, optionally, in order to chromium coat the member for use as a xerographic belt, an acid dip zone is established as step (f) for the core member which comprises an acid dip solution maintained at a temperature of from 65° to 75° F., preferably 70° F., and having a pH of from 1.7 to 2.0. Preferably, the pH is 1.85. Then the core member cathode, while the core member cathode is still wet from the rinse, i.e. step (e), the core member is placed into the acid dip solution for a period of 4 to 6 minutes. The preferred time in the acid dip solution is 5 minutes.

The preferred method is that the core member cathode is placed into the acid dip solution of step (f) while the core member cathode is being rotated at 28 to 30 rpms until the core member cathode is completely in the acid dip.

The most preferred method is while the core member cathode is wet from rinsing step (e) the core member is placed into the acid dip solution of step (f) while the core member cathode is being rotated at 28 to 30 rpms until the core member cathode is completely in the acid dip, then the core member cathode is rotated at 36 to 40 rpms for 1 minute.

A more preferred method is where the core member cathode of step (f) has been rotated at 28 to 30 rpms and has also been rotated at 36 to 40 rpms for 1 minute, it is then rotated at 10 to 15 rpms.

More broadly, sufficient agitation should be imparted to the acid dip solution to continuously expose the core member cathode to fresh acid dip solution while maintaining the acid dip solution within the zone at a stable equilibrium composition comprising:

$H_2SO_4$ - 0.08 to 0.18 oz/gal, preferably 0.13 oz/gal

Then the core member cathode is removed from the acid dip solution. The core member is rinsed with water, i.e. step (g), sufficiently to remove the acid dip solution from the core member cathode.

The preferred rinsing procedure of this step, i.e. step (g) comprises rinsing the core member cathode with water at a rate of 1.5 to 2 gallons per minute while the core member cathode is rotated at 7 to 10 rpms for at least 6 complete revolutions.

The most preferred rinsing procedure of step (g) comprises rinsing the core member cathode, after the above preferred rinsing step with water at a rate of 5 gallons per minute while rotating the core member cathode at 30 to 40 rpms for 1 to 2 minutes.

Preferably, the next step which is carried out prior to the core member entering a chromium bath is a "pre-electrolyze" or "dummy bath" which is a process to achieve uniform conductivity and activity of the anodes. Otherwise a non-uniform or low current may be produced on the work. Also, local burned areas and other undesirable effects may be produced. The inactivity of the anodes which occurs during extended period of downtime usually results in passive films of lead chromates forming on these anodes. Therefore, the conventional practice of producing uniform activity by "pre-working" or "dummying" the chrome process may be used. The "dummy bath" may comprise providing a pre-cathode of lead which is placed in a chromium bath which is described below. The anode to cathode surface area ratio is at least 24 to 1 and this pre-cathode stays in the bath for at least 15 minutes with a current density of at least 200 amps. Then the pre-cathode is removed from the chromium bath prior to the core member cathode entering the below described chromium bath.

A chromium electroforming zone is established as step (h) which comprises a metal anode selected from the group consisting of lead or lead alloys preferably a lead alloy, for example, a lead/tin alloy, lead-antimony-silver alloy or a lead-chromium alloy. The cathode may comprise the core member. The preferred anode to core member cathode surface area ratio is 1 to 1. The anode and core member cathode are separated by the chromium bath maintained at a temperature of about 100° to 116° F. The preferred temperature is about 112° F. The core member cathode enters the chromium bath and remains in the chromium bath for at least 4 seconds before applying at least 200 amps per square feet of current density to the bath for a sufficient time to deposit at least 1 mil of chromium on the core member cathod. The preferred procedure of step (h) is that when the core member cathode first enters the chromium bath, for 4 seconds before applying any current density, the core member cathode is rotated at 4 to 6 rpms.

At least sufficient agitation should be imparted to the chromium bath to continuously expose the core member cathode to fresh bath while maintaining the bath within the chromium electroforming zone at a stable equilibrium composition comprising:

Trivalent chromium ($Cr^{+3}$) is not added as a compound but is produced in situ and is balanced by anions in the bath such as $CrO_4^{-2}$, $SO_4^{-2}$, etc.

(trivalent chromium) — $Cr^{+3}$ less than 0.5 oz/gal, preferably 0.0 oz/gal $CrO_3$ (chromic acid anhydride) (hexavalent chromium) — $Cr^{+6}$ 30 to 35 oz/gal, preferably 33 oz/gal (fluoride ion) — $F^-$ (as fluorosilicate) 0.45 to 0.55 oz/gal, preferably 0.5 oz/gal sulphate 0.15 to 0.25 oz/gal, preferably 0.2 oz/gal It is preferred to use any sulfate/fluoride or sulfate/fluosilicate catalyzed chromium bath under conditions which will produce deposits of chromium with a surface crack density of from about 400 to 800 cracks per linear inch.

Then the core member cathode is removed from the chromium bath solution from the core member cathode.

The preferred process for making a nickel coated cylindrically shaped hollow core mandrel suitable for chromium coating for use in an electroforming process for the production of endless seamless nickel xerographic belts comprises (a) providing a cylindrically shaped hollow core member of aluminum, (b) establishing an anodizing zone comprising a metal cathode of lead and an anode comprising the core member. The cathode and the core member anode are immersed in an anodizing bath maintained at a temperature of 79° F. After the core member anode has been exposed to the bath from 1 to 3 minutes without any voltage applied, then a gradually applied voltage of 16 volts is applied for a period of 15 minutes while the core member anode is rotated in the anodizing bath at 1.5 to 3 rpms and the anodizing bath is maintained within the anodizing zone at a stable equilibrium composition comprising $H_3PO_4$ present in the anodizing bath in amounts of 3.0 parts $H_3PO_4$ to 7 parts $H_2O$. Then step (c) comprises removing the core member anode from the anodizing bath while the voltage is still being applied to the anodizing bath and rinsing the core member anode with water at a rate of at least 1.5 to 2 gallons per minute while the core member anode is rotated at 7 to 10 rpms for at least 6 complete revolutions. Then a second rinse is applied after step (c) and before (d) where the core member anode is rinsed with water at a rate of 5 gallons per minute while rotating the core member anode at 30 to 40 rpms for 5 to 10 minutes. Then step (d) comprises establishing a nickel electroforming zone comprising a metal anode of nickel and a cathode comprising the core member. The core member cathode and metal anode are exposed to a nickel bath maintained at a temperature of 135° F. and having a ramp current when the core member cathode enters the nickel bath of 10 to 20 amps per square feet and a voltage of 3 volts. The core member cathode is rotated at 28 to 32 rpms. Then the ramp current is increased over a period of at least 5 seconds to a ramp current of 100 amps per square feet while rotating the core member cathode at 36 to 40 rmps. The nickel bath is maintained within the nickel electroforming zone at a stable equilibrium composition comprising:

total nickel (for example nickel sulfate or nickel sulfomate at 10 oz/gal halide is chlorine (as nickel chloride) at 1.0 to 1.4 oz/gal $H_3BO_3$ at 5.0 oz/gal The surface tension of the nickel bath should be continuously maintained at 38 dynes per cm while maintaining the pH of the nickel bath of step (d) at 4.1. The anode to core member cathode surface area ratio in step (d) is 1.5 to 1.

After step (d) is completed, the core member cathode is rotated at 28 to 30 rpms and then removed from the nickel bath of step (d). The core member cathode is then rinsed with water, i.e. step (e) at a rate of 1.5 l to 2 gallons per minute while the core member cathode is being rotated at 7 to 10 rpms for at least 6 complete revolutions. After this rinse step, i.e. step (e), a second rinse is performed wherein the core member cathode is then rinsed with water at a rate of 5 gallons per minute while rotating the core member cathode at 30 to 40 rpms for 5 to 10 minutes. Then step (f) is started by establishing an acid dip zone for the core member cathode which comprises an acid dip solution maintained at a temperature of 70° F. and having a pH of 1.85. The core member cathode, step (f), is then placed into an acid dip solution while the core member cathode is still wet from step (e) for a period of 5 minutes. The core member cathode should be rotated at 28 to 30 rpms until the core member cathode is completed into the acid dip. Then the core member cathode is rotated at 36 to 40 rpms for one minute. After the core member cathode has been rotated for 1 minute at 36 to 40 rpms, it is then rotated at 10 to 15 rpms in order to continuously expose the core member cathode to fresh acid dip solution. The acid dip solution within the zone is maintained at a stable equilibrium composition comprising:

$H_2SO_4$ at 0.13 oz/gal

Then step (g) is started by removing the core member cathode from the acid dip solution and rinsing the core member cathode with water at a rate of 1.5 to 2 gallons per minute while the core member cathode is being rotated at 7 to 10 rpms for at least 6 complete revolutions. After this rinse another rinse of the core member cathode is then begun with water at a rate of 5 gallons per minute while rotating the core member cathode at 30 to 40 rpms for 5 to 10 minutes.

Then prior to step (h), the chromium bath, and prior to the core member cathode entering the chromium bath, a cathode of lead is placed in the below described chromium bath. The anode to cathode surface area ratio should be 24 to 1. The cathode of lead is placed in the chromium bath for at least 15 minutes at a current density of at least 200 amps. Then the cathode is removed from said chromium bath. Then step (h) begins by providing a chromium electroforming zone comprising a metal anode of lead alloy and a cathode comprising the core member. The anode and core member cathode are separated by a chromium bath maintained at a temperature of about 112° F. The core member cathode enters the chromium bath and remains in the chromium bath for at least 4 seconds, but before applying any current density. During this time the core member cathode should be rotated at 4 to 6 rpms. Then 200 amps per square feet of current density is applied for a sufficient time to deposit at least 1 mil of chromium on the core member cathode. During this deposition time, the core member cathode is rotated at 20 to 32 rpms while said current density is being maintained at 200 amps per square feet. The bath during this time is maintained within the chromium electroforming zone at a stable equilibrium composition comprising:

(trivalent) $Cr^{+3}$ at about 0.5 oz/gal (hexavalent) $Cr^{+6}$ at 33 oz/gal $F^-$ (as fluorosilicate) at 0.50 oz/gal sulfate at 0.2 oz/gal The anode to core member cathode area ratio in this step (h) is 1 to 1.

After step (h), then step (i) begins which comprises removing the core member cathode from the chromium bath after the current density is reduced to zero. Then the core member cathode is rinsed with water at a rate of 1.5 to 2 gallons per minute while the core member cathode is being rotated at 7 to 10 rpms for at least 6 complete revolutions. After this rinse a second rinse is given to the core member cathode with water at a rate of 5 gallons per minute while rotating the core member cathode at 30 to 40 rpms for 5 to 10 minutes.

BRIEF DESCRIPTION OF DRAWINGS

The present invention will become more apparent from the following discussion and drawing which provides the schematic flow diagram illustrating (1) the cleaning of the aluminum core, i.e. mandrel, (2) the anodizing step utilizing an anodizing bath, (3) a rinsing step (4) plating in a nickel plate bath step, (5) a rinsing step, (6) acid dip step, (7) rinsing step and (8) a chromium plating bath step.

DETAILED DESCRIPTION OF THE DRAWINGS

In the FIGURE step 1 represents the initial cleaning of the cylindrically shaped hollow core mandrel before any of the plating process steps being on the mandrel. The preferred cleaning step begins by wiping the mandrel surface completely with a litho wipe, i.e. soft paper material using in the lithographic industry, dampened with acetone. The outside surface of the mandrel may then be scrubbed with a nylon pad, such as Scotch Brite®, and alpha alumina by using circular motions with moderate pressure. The circles are kept to about 6 inches in diameter. This cleaning step may be done while the mandrel is rotating at about 3 to 5 rpms. This procedure may be repeated by rotating the mandrel in both directions. The residue of alpha alumina is then rinsed off. The mandrel rotation may then be increased to 30 to 40 rpms. The mandrel is then cleaned again by using alpha alumina. The mandrel is then transversed with fresh nylon pad. This may be done while rotating the mandrel in both directions. The mandrel is then rinsed off and wiped with a litho wipe or a paper towel. The above procedure of using the nylon pad and alpha alumina may be repeated using litho wipes and alpha alumina.

The cleaning step may further include getting rid of all the loose aluminum left on the surface of the hollow core mandrels by cleaning the surface of the mandrel by rubbing the surface with litho wipes using considerable pressure until the wipes no longer pick up any visible residue. This may be done by rotating the mandrels in both directions. Then the rotation of the mandrel may be increased to 35 to 40 rpms. A continuous flow of water may be cascaded over the mandrel surface during this entire step. The direction of rotation may be repeatedly reversed until no more residue is observed on the litho wipes.

The mandrel may now be transferred to the anodizing bath step 2 as shown in the diagram or left to dry. If the mandrel is left to dry, the mandrel should be wetted again before being placed into the anodizing bath. The second step as shown in the FIGURE is, as mentioned, the anodizing bath step. The mandrel enters the bath with no voltage being applied. The mandrel should be wet from the rinsing and cleaning step. The mandrel is allowed to stand in the anodizing bath without any voltage being applied for 1 to 3 minutes while the anode core member, i.e. mandrel, is being rotated at about 1.5 to 3 rpms.

The anodizing bath is maintained at a stable equilibrium composition which is as follows:

| Parameter | Preferred Range | Range |
|---|---|---|
| temperature | 79° F | 78 to 80° F |
| concentrated $H_3PO_4$ | 30% by volume | 27% to 37% by volume |
| time | 15 minutes | 10 to 20 minutes |
| voltage+ | 16 | 15 to 17 |
| cathode | lead | lead |
| cathode/anod ratio | 1:1 | at least 1:1 |

+voltage is brought up slowly and not allowed to exceed 17 volts at any time
*concentrated $H_3PO_4$ is 85% $H_3PO_4$ by weight. 30%/85% equals 3 parts concentrated $H_3PO_4$ to 10 parts deionized water Normally the anodizing bath is kept free of lint and other airborne particulates. The anodizing bath should be filtered after about every 20 uses to remove cathode sludge. The bath life preferably lasts for about 100 uses.

When the core member anode is removed from the anodizing bath, it is important that the voltage remain on so that imperfections, e.g. barbs, will not appear again on the surface of the core member anode. After the core member anode, i.e. mandrel, is removed from the bath while the voltage is still being applied, the mandrel is rinsed off as soon as possible, i.e. the "full rinse" is begun as soon as the mandrel clears the anodizing bath tank.

A "full rinse" is defined for the purposes of the instant application as a four step process. Step I, deionized water is cascaded over the core member at 1.5 to 2 gallons per minute. The water is directed so that it will cascade over the face of the mandrel, i.e. core member. This is done while the mandrel is being rotated at 7 to 10 rpms. The mandrel should rotate for at least 6 complete revolutions during this step. Step II involves flowing water which is now increased to 5 gallons per minute over the mandrel while the mandrel is being rotated at an increased rate of from 30 to 40 rpms. Step III is the same as Step I. Then in Step IV, the deionized water is washed over the mandrel at 1.5 to 2 gallons per minute while the mandrel is being rotated at 7 to 10 rpms.

In the FIGURE at step 4, the mandrel enters a nickel bath. The mandrel is now used as a cathode and enters the nickel bath while voltage is being applied. This is a very important step. If the mandrel, i.e. cathode, enters the nickel bath without the voltage being applied, the bath will dissolve the anodizing layer and will expose the slivers or barbs, i.e. imperfections, in the aluminum surface of the mandrel. If these barbs or slivers are exposed, then the mandrel will be rejected for use in forming nickel belts thereon. This was a serious problem until this critical step was discovered, i.e. the mandrel containing the anodizing layer from the anodizing bath must enter the nickel bath while the voltage is being applied to the nickel bath. The anodizing layer protects the aluminum layer until nickel can be plated onto the mandrel. This is done before the nickel bath can attack the unprotected aluminum surface. The voltage, when the mandrel enters the nickel bath, should be about 3 volts and about 10 to 20 amps. The core member cathode, i.e. mandrel, should be wet from the post anodizing rinsing step. The cathode core member, i.e. mandrel, should be rotated at about 28 to 32 rpms. When the mandrel is completely in the nickel bath, rotation of the mandrel may be increased to 36 to 40 rpms. Then the ramp current is increased from the 10 to 20 amps per square feet to a ramp current of from 75 to 150 amps per square feet over a 5 second period.

The nickel electroforming bath is a stable equilibrium composition comprising the following parameters:

| Parameters | Preferred Ranges | Range |
|---|---|---|
| Ni (nickel sulfate or sulfomate) | 10 oz/gal | 9 - 10 oz/gal |
| $NiCl_2 \cdot 6H_2O$ | 1.2 oz/gal | 1.0–1.4 oz/gal |
| $H_3BO_3$ | 5 oz/gal | 4.8–5.2 oz/gal |
| Surface Tension | 38 dynes/cm | 33–48 dynes/cm |
| pH | 4.1 | 3.8 - 5.3 |
| temperature | 135° F | 132 - 138° F. |
| anode material | Ni | |
| anode to cathode area ratio | at least 1.5 to 1 | at least 1.5 to 1 |

The nickel bath should be preferably continuously filtered with a total filtration preferably every 500 to 1000 amp hours which is about equal to the preparation of 50 mandrels at about 1 mil of nickel plating per mandrel. The life of the bath should be preferably about 200 uses at 1 mil nickel plating on radius of the mandrel.

After the nickel bath procedure is terminated, the mandrel, i.e. core member cathode, is rotated at 28 to 30 rpms and removed from the nickel bath solution. Then process No. 5 of the Figure is begun with a "quick rinse". The "quick rinse" is started as soon as the mandrel starts to clear the nickel bath solution. A "quick rinse" is the same as Step I of the "full rinse" described above. The only exception is that the mandrel is only rotated for at least 3 revolutions instead of 6 revolutions.

In reference to the FIGURE, Process No. 6, this process involves the acid dip step. The core member cathode, i.e. mandrel, after the rinsing process of Step 5 is moved into the process Step 6, i.e. the acid dip process. The mandrel enters the acid dip with no voltage being applied. However, the mandrel should be wet from the rinse Step 5 while entering the acid dip bath. The mandrel should be rotating at about 28 to 30 rpms.

The rotation should be increased to 36 to 40 rpms as soon as the mandrel is completely in the acid dip solution. This rotation should be maintained for at least 1 minute. The rotation is then slowed to 3 to 5 rpms and the machinery checked to see that the mandrel is securely attached to all connections for good electrical contacts. Then the mandrel is rotated at 10 to 15 rpms. The composition of the acid dip solution is as follows:

| Parameter | Preferred Range | Ranges |
|---|---|---|
| $H_2SO_4$ | 0.13 oz/gal | 0.08 - 0.18 oz/gal |
| temperature | 70° F | 65 - 75° F |
| time | 5 minutes | 4 - 6 minutes |
| pH | 1.85 | 1.7 - 2.0 |

The surface of the bath should preferably be kept free of lint and other airborne particulates. The bath should preferably be changed every 20 uses.

A "full rinse", step 7 of the FIGURE, should be started as soon as the mandrel begins to leave the acid dip solution. The "full rinse" is the same as described previously in the application.

At this point, it may be advantageous to inspect the mandrel. This is done (1) by wearing latex gloves, (2) maintaining a small amount of water on the mandrel while the mandrel is being rotated very slowly, and (3) then using the hand to lightly transverse over the surface of the mandrel. Any irregularities in the surface of the mandrel should result in the rejection of the mandrel. After this inspection, the mandrel is moved through the rinse Step 7, i.e. "full rinse", and then moved into process Step 8 of the FIGURE which is the chromium plating step. It was preferred that when the mandrel enters into the chromium bath, that the mandrel be wet from the rinse cycle shown in Step 7 of the FIGURE.

It is preferred that prior to the core member cathode, i.e. mandrel, entering the chromium bath that a precathode of lead be used in the chromium bath, i.e. a "dummy bath", which has at least an anode to cathode size ratio of 24 to 1. The "dummying" should be carried out for at least 15 minutes at a current density of at least 200 amps before the core member cathode, i.e. mandrel, enters the chromium bath.

It is preferred that this "dummying" be carried out within 1 hour prior to the use of the bath for plating the core member cathode, i.e. mandrel.

The mandrel should enter the chromium bath with no voltage being applied to the bath. The mandrel should be allowed to stand for 4 seconds in the chromium bath before applying current. The mandrel is then rotated at a speed of 4 to 6 rpms and a current is applied with no ramp, i.e. current is applied immediately. This current should be at least 200 amps per square feet of current density. The current should be maintained for a sufficient time to deposit at least 1 mil of chromium on the core member cathode, i.e. mandrel. The chromium electroforming bath is a stable equilibrium composition which may comprise:

| Parameters | Preferred Ranges | Ranges |
|---|---|---|
| temperature | 112° F | 110 - 116° F |
| $Cr^{+3}$ (trivalent chromium) | 0 to 1 oz/gal | less than 0.5 oz/gal |
| $Cr^{+6}$ (hexavalent chromium) | 33 oz/gal | 30 - 35 oz/gal |
| F− (*as fluoro-*silicate) | 0.50 oz/gal | 0.45 - 0.55 oz/gal |
| sulfate | 0.2 oz/gal | 0.15 - 0.25 oz/gal |

-continued

| Parameters | Preferred Ranges | Ranges |
|---|---|---|
| current density | 200 amps/ft$^2$ | |
| time | about 90 min. (for 1 mil of chromium) | |
| anode | lead | |
| anode to cathode ratio | 1:1 | |

The chromium bath should preferably be maintained with continuous circulation and the bath should preferably be filtered continuously.

The core member cathode, i.e. mandrel, should be taken from the chromium bath while the voltage is turned off. It should be noted that the mandrel should preferably be given a "full rinse" while the mandrel is still over the chromium bath tank. The full rinse is described previously in the application. The mandrel is then cooled to room temperature and given a second "full rinse".

The following Examples further specifically define the present invention with respect to the method of making a chromium coated cylindrically shaped hollow core mandrel suitable for use in an electroforming process for the production of endless seamless nickel xerographic belts.

The percentages are by weight unless otherwise indicated.

The Examples below are intended to illustrate various preferred embodiments of the instant invention.

EXAMPLE I

A cylindrically shaped, hollow aluminum core of 6061, T6 aluminum, available from Aluminum Company of America, approximately 19 inches in (inside) diameter and about 21.5 inches in (outside) diameter and about 24 inches in height with walls approximately 1.5 inches thick is provided. The core is then machined down to the proper size, i.e. 20.670 inches ±2 mils, with the core wall thickness now approximately 1 inch. The surface of the outside of the core is very smooth without any visible defects, i.e. free of nicks, scratches and tool marks. The RMS (route mean square) which is a measurement of the surface smoothness, measured in microinches of about 10 to 15 microinches.

The core is blown free of grit or dirt or any foreign material which might cause damage.

The core is then inspected to determine if it is free of all nicks and scratches.

Then the core is cleaned by washing with acetone to remove any oil, etc. Then those surfaces which are not to be plated are masked. The masking material must be non-reactive with the subsequent plating baths.

The ends of the core must be plugged or masked so that the inside of the core is not plated.

The core is hooked up to a hoist so that the core can be moved between the various baths. The core must be mounted such that the mounting apparatus and core can be rinsed so that all the material on the core and mounting, i.e. the previous bath, can be removed by rinsing before entering a subsequent bath.

The ends of the core are connected to "robbers". The "robbers" steal plating from the ends of the core during the plating operation ensuring that the plating on the edges which may be the same as, i.e. thickness, the plating in the center of the core. The "robber" must be such so it can be completely rinsed.

The core, i.e. mandrel, is given another complete cleaning. Acetone is applied to the surface of the mandrel by a squirt bottle, i.e. flush the surface of the mandrel, then the surface is wiped with a litho wipe, i.e. a paper cloth, which is damp with acetone. This removes any organic contaminates.

The mandrel is then scrubbed to further clean the surface, i.e. chemically cleaned.

The mandrel's surface is scrubbed with a nylon pad, i.e. Scotch Brite ®, and alpha alumina. The alpha alumina is very fine about 0.3 microns.

Then the mandrel is scrubbed with a soft material, i.e. paper cloth, i.e. paper towel, and then alpha alumina. The mandrel should be scrubbed in both directions. The mandrel should be completely scrubbed.

All traces of the alpha alumina is removed. This is done by flushing the mandrel with deionized water while rubbing the surface with clean litho wipes until all evidence that the alpha alumina is gone. The mandrel is rubbed with the litho wipes until there is no black obtained on the litho wipes. During this process, deionized water is cascaded over the mandrel.

The mandrel is moved to the anodizing bath. The bath is 3 parts 85% $H_3PO_4$ to 10 parts deionized water. The temperature of the bath is about 79° F. The bath is about 140 gallons in a gallon tank. The cathode is of lead and the cathode to anode, i.e. mandrel, surface area ratio is 1 to 1. The mandrel enters the bath with no voltage applied to the bath. The mandrel should be wet from the deionized water rinse. The mandrel should stand in the anodizing bath for 2 minutes while slowing rotating at about 2.5 rpms. The voltage is increased slowly and not allowed to exceed 17 volts. The mandrel remains in the anodizing bath for about 15 minutes. The voltage is at 16 volts. The mandrel is removed from the anodizing bath while the voltage is still being applied. A "full rinse" is begun as soon as the mandrel clears the tank.

One should be absolutely sure that all residue of the previous bath is removed from the mandrel before the mandrel enters the next bath.

A "full rinse" is given to the mandrel. The "full rinse" is first step I where deionized water is directed from a ¾ inch pipe at about 1.5 to 2 gallons per minute onto the mandrel. The mandrel is being rotated from about 7 to 10 rpms. This is continued for at least 6 complete revolutions. Then step II where the flow of water is increased to about 5 gallons per minute while rotating the mandrel at about 30 to 40 rpms. Then step I is repeated. After this, the mandrel is slowed to 7 to 10 rpms while rinsing with deionized water at 1.5 to 2 gallons per minute. Then the water is directed at about 1.5 to 2 gallons per minute while the mandrel is rotated at about 7 to 10 rpms to specific parts of the mandrel, i.e. the mounting apparatus, etc. in order to assure that all the crevices are free of any residue from the anodizing bath. The "robber rings" and mounting apparatus should be free of any anodizing bath residue.

The mandrel is moved to the nickel bath while it is still wet from the rinse step. The nickel bath is in a 180 gallon tank with 170 gallons of nickel bath. The bath is (1) nickel at a concentration of 10 oz/gallon, (2) $NiCl_2.6H_2O$ at a concentration of 1.2 oz/gallon, (3) $H_3BO_3$ at a concentration of 5 oz/gallon. The surface tension is about 38 dynes per cm. The pH is about 4.1. The temperature is about 135° F. The anode is nickel. The anode to cathode, i.e. mandrel, surface area ratio is 1.5 to 1.

The mandrel enters the nickel bath while the voltage is applied. The mandrel is rotating at about 30 rpms. The voltage is about 3 volts at 15 amps. As soon as the mandrel is completely in the bath, the rotation of the mandrel is increased to 35 rpms. The current, i.e. ramp current, is increased over a period of 30 seconds from about 15 amps to about 100 amps per square feet. The bath should be continuously filtered with a skimmer, i.e. constantly taking residue from the top of the bath.

The amount of time in the nickel bath depends upon the final diameter you wish the mandrel to have. Here the mandrel should stay in the bath long enough to plate 1.0 mils of nickel, i.e. 1 mil of nickel on the radius of the mandrel. The final diameter of the nickel coated mandrel should be 22.670 inches ±2 mils. After the plating is completed, the mandrel is slowly rotated at about 29 rpms while removing from the nickel bath. The "quick rinse" is started as soon as the mandrel starts to clear the nickel bath. The "quick rinse" is the same as step I of the "full rinse" described previously in this example.

The mandrel enters the acid dip bath immediately upon leaving the rinse, i.e. post nickel bath rinse. The mandrel is still wet from the rinse.

The acid dip bath is in a 150 gallon tank with 140 gallons of acid dip bath. The acid dip bath comprises 0.13 ounces of $H_2SO_4$ per gallon. The temperature of the bath is 70° F. and the pH is 1.85.

The mandrel enters the acid dip bath with no voltage being applied. The mandrel is being rotated while it enters the acid dip bath at 29 rpms. As soon as the mandrel is completely in the acid dip bath, the rpms are increased to 35. These conditions are maintained for at least 1 minute. The mandrel is slowed to 4 rpms to assure that the mandrel is still tight to its hanger. Then the rpms are increased to 12.5 rpms. The mandrel stays in the acid bath for 5 minutes. As soon as the mandrel starts to leave the acid dip bath a "full rinse", as described in the beginning of this example, is begun.

The surface of the mandrel is kept wet while it is inspected for defects. It is inspected by feeling of the surface with the hand covered with a thin rubber gloove.

The mandrel is moved to the chromium bath. The chromium bath is in a 250 gallon tank with 240 gallons of chromium bath. The chromium bath is (1) 33 oz/gallon hexavalent chromium, (2) 0.50 oz/gallon of fluorosilicate present in order to furnish $F^-$ ion and (3) 0.2 oz/gallon of sulfate. The bath is at about 112° F. The anode is lead/tin alloy. The anode to cathode, i.e. mandrel, surface area ratio is 1 to 1.

The chromium bath is "dummied" prior to the mandrel entering the bath. A lead/tin alloy cathode is used with the lead/tin alloy anode. The anode to cathode surface area ratio is 24 to 1. A current density of 200 amps is used. This activates the anodes for later use. This is continued for 15 minutes.

The mandrel is wet from the previous rinse. The mandrel then enters the chromium bath while rotating at about 5 rpms and remains in the chromium bath for at least about 4 seconds before any current is applied. Current is applied with no ramp. The current is about 200 amps per square feet. The mandrel is allowed to stay in the bath until about 1 mil chromium is plated onto the mandrel. The diameter of the mandrel should be about 24.672 ± 2 mils.

The mandrel is then masked on the inside and mounted to a lift apparatus and cleaned.

The mandrel is heated to the temperature of a nickel belt plating bath used for plating nickel xerographic belts.

The mandrel is then placed into the plating cell. The cell contains a nickel belt plating bath at about 150° F. The nickel is plated onto the mandrel to a thickness of about 4.5 mils ±1.0 mils. The plating is for about 18 minutes at 300 amps per foot. The mandrel plus the belt plating is removed from the cell and placed in a tank, i.e. drag out tank, at about 70° F., which cools the mandrel. Then the mandrel plus the belt contained thereon are placed in a cold soak bath, i.e. water, at about 40 to 50° F. A gap between the mandrel and the nickel belt is formed. The belt is then taken off of the mandrel at a parting station. The belt is now ready for use as a substrate in a photoreceptor which may be used in a xerographic machine, such as a Xerox 9200® xerographic machine.

Mandrels having thicker nickel or chrome plates may be made by the same process as described herein. This process may also be used for mandrel repair and/or core salvage. Cores that are machined undersize to remove surface defects can still be used by correcting the dimensions by thicker plates of Ni or Cr. Ni plates 0.060 inches are possible without run out problems.

What is claimed is:

1. A process for making a nickel coated cylindrically shaped hollow core mandrel suitable for chromium coating for use in an electroforming process for the production of endless seamless nickel xerographic belts comprising:

a. providing a cylindrically shaped hollow core member consisting essentially of a material selected from the group consisting of aluminum and aluminum alloys;

b. establishing an anodizing zone comprising a metal cathode selected from the group consisting of lead and lead alloys and an anode comprising said core member, said cathode and said core member anode being separated by an anodizing bath maintained at a temperature of 78 to 80° F. and after said core member anode has been exposed to said bath from 1 to 3 minutes without any voltage applied then gradually applying a voltage of 15 to 17 volts over a period of about 10 to 20 minutes to said anodizing bath, while imparting sufficient agitation to said anodizing bath to continuously expose said core member anode to fresh anodizing bath, maintaining said anodizing bath within said zone at a stable equilibrium composition comprising:
$H_3PO_4$ at 2.7 to 3.7 parts concentrated $H_3PO_4$ to 6.3 to 7.3 parts $H_2O$ c. removing said core member anode from said anodizing bath while said voltage of 15 to 17 volts is being applied to said anodizing bath and then rinsing said core member anode with water sufficiently to remove said anodizing bath solution from said core member anode; then d. establishing a nickel electroforming zone comprising a metal anode selected from the group consisting of nickel and nickel alloys and a cathode comprising said core member, said core member cathode and said metal anode are separated by a nickel bath maintained at a temperature of 132° to 138° F. and having a ramp current when the core member cathode enters said nickel bath of from 10 to 20 amps per square feet and a voltage of 3 volts and increasing said ramp current over a period of at least 5 seconds to a ramp current of from 75 to 150 amps per square feet while imparting sufficient agitation to said nickel bath to continuously expose said core member cathode to fresh nickel bath, maintaining said nickel bath within said nickel electroforming zone at a stable equilibrium composition comprising:
total nickel 9 to 11 oz/gal
halide as $NiX_2.6H_2O$ — 1.0 to 1.4 oz/gal wherein X is selected from the group consisting of chlorine, iodine and bromine,
$H_3BO_3$ at 4.8 to 5.2 oz/gal
continuously maintaining the surface tension of the nickel bath at 33 to 42 dynes per cm;

e. removing said core member cathode from said nickel bath while still imparting sufficient agitation to said nickel bath to continuously expose said core member cathode to fresh bath and then rinsing said core member cathode with water sufficiently to remove said nickel bath solution from said core member cathode.

2. The process of claim 1 which comprises the additional following subsequent steps of:

f. establishing an acid dip zone for said core member cathode comprising an acid dip solution maintained at a temperature of from 65° to 75° F. and having a pH of from 1.7 to 2.0, placing said core member cathode while said core member cathode is still wet from the rinsing step (e) into said acid dip solution for a period of from 4 to 6 minutes, imparting sufficient agitation to said acid dip solution to continuously expose said core member cathode to fresh acid dip solution, maintaining said acid dip solution within said zone at a stable equilibrium comprising:
$H_2SO_4$ at 0.08 to 0.18 oz/gal g. removing said core member cathode from said acid dip solution and then rinsing said core member cathode with water sufficiently to remove said acid dip solution from said core member cathode; then h. establishing a chromium electroforming zone comprising a metal anode selected from the group consisting of lead and lead alloys and a cathode comprising said core member, said anode and core member cathode being separated by a chromium bath maintained at a temperature of about 110° to 116° F. and having said core member cathode enter said chromium bath and remain in said chromium bath for at least 4 seconds before applying at least 200 amps per square feet of current density for a sufficient time to deposite at least 1 mil of chromium on said core member cathode, imparting sufficient agitation to said chromium bath to continuously expose said core member cathode to fresh bath, maintaining said bath within said chromium electroforming zone at a stable equilibrium composition comprising:
$Cr^{+3}$ (trivalent chromium) at less than 0.5 oz/gal
$CrO_3$ (chromic acid anhydride) (hexavalent chromium) at 30 to 35 oz/gal
$F^-$ (as fluorosilicate) at 0.45 to 0.55 oz/gal sulfate at 0.15 to 0.25 oz/gal i. and then removing said core member cathode from said chromium bath after the current density is reduced to zero and then rinsing said core member cathode with water sufficiently to remove said chromium bath solution from said core member cathode.

3. The process of claim 1 wherein the cylindrically shaped hollow core mandrel is aluminum.

4. The process of claim 1 wherein the metal cathode in the anodizing step (b) is lead.

5. The process of claim 1 wherein the anodizing bath of step (b) is at a temperature of 79° F.

6. The process of claim 1 wherein the applied voltage of step (b) is 16 volts and the period during which the voltage is being applied is for 15 minutes.

7. The process of claim 1 wherein said core member anode is rotated in said anodizing bath, step (b), at 1.5 to 3 rpms.

8. The process of claim 1 wherein $H_3PO_4$ is present in the anodizing bath, step (b), in amounts of 3.0 parts $H_3PO_4$ to 7.0 parts $H_2O$.

9. The process of claim 1 wherein said core member anode is rinsed in step (c) with a first rinse of water at a rate of at least 1.5 to 2 gallons per minute while the core member anode is being rotated at 7 to 10 rpms for at least 6 complete revolutions.

10. The process of claim 9 wherein the core member anode is rinsed again with a second rinse of water at a rate of 5 gallons per minute while rotating the core member anode at 30 to 40 rpms for 5 to 10 minutes.

11. The process of claim 1 wherein the metal anode of step (d) is nickel.

12. The process of claim 1 wherein said nickel bath of step (d) is maintained at a temperature of 135° F.

13. The process according to claim 1 wherein the cathode in step (d) is rotated at 28 to 32 rpms while said amps per square feet are maintained at 10 to 20 and the voltage is at 3 volts.

14. The process according to claim 1 wherein the core member cathod in step (d) is rotated at 36 to 40 rpms after the ramp current is increased to 75 to 150 amps per square feet.

15. The process according to claim 14 wherein the ramp current is increased to 100 amps per square feet.

16. The process of claim 1 wherein the composition of said nickel bath of step (d) is total nickel as nickel sulfate in said composition is at 10 oz/gal.

17. The process of claim 1 wherein the $NiX_2.6H_2O$ composition of said nickel bath of step (d) is at a concentration of 1.2 oz/gal.

18. The process of claim 17 wherein said halide ($NiX_2$) is nickel chloride.

19. The process of claim 1 wherein the $H_3BO_3$ composition of said bath of step (d) is at a concentration of 5 oz/gal.

20. The process of claim 1 wherein the surface tension of the nickel bath of step (d) is at 38 dynes/cm.

21. The process of claim 1 wherein the pH of the nickel bath of step (d) is 4.1.

22. The process of claim 1 wherein the nickel bath of step (d) is at a temperature of 135° F.

23. The process of claim 1 wherein the anode to core member cathode surface area ratio in step (d) is 1.5 to 1.

24. The process of claim 1 wherein after step (d) is completed the core member cathode is rotated at 28 to 30 rpms and then removed from the nickel bath of step (d).

25. The process according to claim 1 wherein the rinsing procedure of step (e) comprises rinsing the core member cathode with water at a rate of 1.5 to 2 gallons per minute while the core member cathode is being rotated at 7 to 10 rpms for at least 6 complete revolutions.

26. The process according to claim 25 wherein the core member cathode is then rinsed with water at a rate of 5 gallons per minute while rotating the core member cathode at 30 to 40 rpms for 5 to 10 minutes.

27. The process according to claim 2 wherein the acid dip solution of step (f) is at a temperature of 70° F.

28. The process according to claim 2 wherein the pH of the acid dip solution of step (f) is 1.85.

29. The process according to claim 2 wherein the core member cathode is placed in the acid dip solution of step (f) for 5 minutes.

30. The process of claim 2 wherein while the core member cathode is wet from step (e) the core member cathode is placed into the acid dip solution of step (f) while the core member cathode is being rotated at 28 to 30 rpms until the core member cathode is completely in said acid dip.

31. The process of claim 30 wherein the core member cathode after being rotated at 28 to 30 rpms while the core member cathode is being placed into the acid bath then the core member cathode is rotated at 36 to 40 rpms for 1 minute.

32. The process of claim 31 wherein the core member cathode after being rotated 1 minute at 36 to 40 rpms is rotated at 10 to 15 rpms in order to continuously expose said core member cathode to said fresh acid dip solution.

33. The process of claim 1 wherein the composition of the acid dip solution of step (f) of $H_2SO_4$ is at 0.13 oz/gal.

34. The process according to claim 2 wherein the rinsing procedure of step (g) comprises a first rinsing the core member cathode with water at a rate of 1.5 to 2 gallons per minute while the core member cathode is rotated at 7 to 10 rpms for at least 6 complete revolutions.

35. The process according to claim 34 wherein the core member cathode is then rinsed with a second rinse of water at a rate of 5 gallons per minute while rotating the core member cathode at 30 to 40 rpms for 5 to 10 minutes.

36. The process according to claim 2 wherein the metal anode of step (h) is an alloy of lead.

37. The process according to claim 2 wherein the chromium bath of step (h) is maintained at a temperature of 112° F.

38. The process of claim 2 wherein the chromium bath composition of step (h) comprises:

$Cr^{+3}$ (trivalent chromium) at less than 0.5 oz/gal $CrO_3$ (chromic acid anhydride) (hexavalent chromium) at 33 oz/gal $F^-$ (as fluorosilicate) at 0.50 oz/gal sulfate at 0.2 oz/gal.

39. The process of claim 38 wherein the current density of step (h) is 200 amps per square feet.

40. The process of claim 38 wherein the anode to core member cathode surface area ratio in step (h) is 1 to 1.

41. The process according to claim 2 wherein in step (h) prior to said core member cathode entering said chromium bath, placing a pre-cathode of lead having at least an anode to cathode size ratio of 24 to 1 in said bath for at least 15 minutes at a current density of at least 200 amps and then removing said pre-cathode from said chromium bath prior to said core member cathode entering said bath.

42. The process of claim 2 wherein in step (h) when said core member cathode first enters said chromium bath for four seconds before applying any current density rotating said core member cathode at 4 to 6 rpms.

43. The process according to claim 2 wherein the core member cathode in step (h) is rotated at 28 to 32 rpms while said current density is maintained at 200 amps per square feet.

44. The process according to claim 2 wherein the rinsing procedure of step (i) comprises a first rinsing of the core member cathode with water at a rate of 1.5 to 2 gallons per minute while the core member cathode is rotated at 7 to 10 rpms for at least 6 complete revolutions.

45. The process according to claim 44 wherein the core member cathode is again riinsed with a second rinse of water at a rate of 5 gallons per minute while rotating the core member cathode at 30 to 40 rpms for 5 to 10 minutes.

* * * * *

United States Patent [19]

Okinaka et al.

[11] 4,067,783

[45] Jan. 10, 1978

[54] GOLD ELECTROPLATING PROCESS

[75] Inventors: Yutaka Okinaka, Madison; Catherine Wolowodiuk, New Providence, both of N.J.

[73] Assignee: Bell Telephone Laboratories, Incorporated, Murray Hill, N.J.

[21] Appl. No.: 779,714

[22] Filed: Mar. 21, 1977

[51] Int. Cl.[2] ..... C25D 3/48; C25D 3/62

[52] U.S. Cl. ..... 204/43 G; 204/46 G; 204/290 F

[58] Field of Search ..... 204/46 G, 43 G, 290 F, 204/109, 110, 111

[56] References Cited

U.S. PATENT DOCUMENTS

| | | | |
|---|---|---|---|
| 3,428,544 | 2/1969 | Bianchi et al. | 204/290 F |
| 3,491,014 | 1/1970 | Bianchi et al. | 204/242 |
| 3,616,445 | 10/1971 | Bianchi et al. | 204/290 F |
| 3,711,385 | 1/1973 | Beer | 204/290 F X |
| 3,865,703 | 2/1975 | Schenker et al. | 204/105 R |
| 3,926,751 | 12/1975 | DeNora et al. | 204/105 R |
| 3,980,531 | 9/1976 | Ludwig et al. | 204/43 R |

FOREIGN PATENT DOCUMENTS

| | | | |
|---|---|---|---|
| 6,616,173 | 5/1967 | Netherlands | 204/46 G |

OTHER PUBLICATIONS

D. Cipvis et al., J. Electroanal, Chem., 73, 125–128, (1976).

F. H. Reid et al., "Gold Plating Technology," pp. 21–52, (1974).

F. A. Lowenheim, "Modern Electroplating," pp. 224–244, (1963).

*Primary Examiner*—G. L. Kaplan

*Attorney, Agent, or Firm*—Walter G. Nilsen

[57] ABSTRACT

Certain reducible species are found in gold electroplating solutions which interfere with efficient electroplating of gold and make uncertain gold thickness predictions based on current throughput. A gold electroplating process is described which minimizes formation of undesirable reducible species. This process uses an anode of titanium having a coating of the oxides of ruthenium, iridium, rhodium, titanium or mixtures thereof. In addition, a procedure is described for removing such chemical species from the gold plating bath which does not adversely affect the gold electroplating solution.

11 Claims, 3 Drawing Figures